US005743022A

United States Patent [19]

Hall Taylor

[11] Patent Number: 5,743,022

[45] Date of Patent: Apr. 28, 1998

[54] SHEET MATERIAL DRYING

[75] Inventor: Nicholas Simon Hall Taylor, Cranbrook, United Kingdom

[73] Assignee: TMCI (UK) Limited, Reading, United Kingdom

[21] Appl. No.: 745,250

[22] Filed: Nov. 8, 1996

Related U.S. Application Data

[63] Continuation of Ser. No. 503,725, Jul. 18, 1995, abandoned.

[30] Foreign Application Priority Data

Jul. 22, 1994 [GB] United Kingdom ..... 9414856

[51] Int. Cl.[6] ..... F26B 19/00

[52] U.S. Cl. ..... 34/68; 34/216; 34/423

[58] Field of Search ..... 34/68, 389, 216, 34/217, 423, 422, 424, 110, 112

[56] References Cited

U.S. PATENT DOCUMENTS

| | | | |
|---|---|---|---|
| 1,932,124 | 10/1933 | Tobey | 34/217 |
| 3,250,315 | 5/1966 | Osborne et al. | 34/216 |
| 3,295,222 | 1/1967 | Geitz | 34/216 |
| 4,045,882 | 9/1977 | Buffington et al. | 34/217 |
| 4,121,350 | 10/1978 | Buchholz | 34/216 |
| 4,359,826 | 11/1982 | Rounsley | 34/68 |
| 4,472,887 | 9/1984 | Avedian et al. | 34/216 |
| 4,631,837 | 12/1986 | Magoon . | |
| 4,704,804 | 11/1987 | Wyatt et al. | 34/217 |
| 4,756,092 | 7/1988 | Anderson et al. | 34/424 |
| 5,024,319 | 6/1991 | Dixon et al. | 34/217 |
| 5,203,354 | 4/1993 | Hickle . | |

FOREIGN PATENT DOCUMENTS

| | | |
|---|---|---|
| A 16 57 227 | 2/1971 | Germany . |
| A 17 57 666 | 5/1971 | Germany . |
| A 6 817 434 | 6/1969 | Netherlands . |
| A-2 058 314 | 4/1981 | United Kingdom . |

*Primary Examiner*—John T. Kwon

*Attorney, Agent, or Firm*—Merchant, Gould, Smith, Edell, Welter & Schmidt

[57] ABSTRACT

A dryer arrangement for use in the production of a dried cast sheet, in particular reconstituted tobacco sheet, is formed of a plurality of steam plates in side-by-side arrangement providing a substantially flat surface. The plates are hollow and a heated fluid is fed to the interior thereof. A slurry of sheet forming material is cast at one end of the flat surface. The cast sheet material travels over the steam plates under momentum imparted thereto by the belt dryer, if used, and/or is transported for example by a heat conductive plastic belt driven over the upper surface of the steam plates to provide good heat transfer between the sheet material being dried and the flat surface of the steam plates.

18 Claims, 3 Drawing Sheets

SHEET MATERIAL DRYING

This is a Continuation of application Ser. No. 08/503,725, filed Jul. 18, 1995, now abandoned.

BACKGROUND FIELD OF THE INVENTION

This invention relates to the drying of sheet material, in particular, but not exclusively, reconstituted tobacco sheet.

THE PRIOR ART

In the production of tobacco products, in particular cigarettes, considerable quantities of chopped tobacco leaf are wasted. Known technology is available for reusing such chopped tobacco material in the production of reconstituted tobacco sheet which is useful, in particular, as a wrapping material for tobacco products, but which may also be chopped to a desired size and used in place of new tobacco. The sheet material is generally produced by use of technology analogous to that used in the paper industry. It is known, for example, to produce the sheet material on a Fourdrinier machine.

In one particular procedure, a slurry of tobacco, water and binding agents is cast on a stainless steel belt at one end thereof and, as the cast slurry is conveyed horizontally by the belt, it undergoes drying. The slurry is dried by a combination of live steam being fed to the underside of the belt and warm air flowing over the belt to remove water evaporated from the slurry. The dried slurry is removed from the belt with the aid of a doctoring knife before reversal of the belt takes place. The solids content of the slurry as originally formed is typically in the range of from 15 to 25% by weight and the moisture content of the slurry when acted upon by the doctoring knife is typically 12 to 15%. At such a low moisture content, doctoring generally requires the use of a belt release agent or lubricant, such as lecithin.

In a variant of this procedure, doctoring is carried out at 25 to 30% moisture content. Such doctoring can be achieved without use of a belt release agent. The sheet is then transferred to a post dryer to reduce the moisture content to the required 12 to 15% by weight. Typically, post drying is carried out on a so-called drum dryer. This consists of a large diameter drum which contains pressurised steam which preferably has a temperature of about 130° C., i.e. considerably in excess of the temperature of the live steam to which the stainless steel belt is subject. The drum rotates slowly and the sheet is fed over the drum to cover about two thirds of its circumference, the sheet being fed to the drum at a slightly lower velocity than the peripheral velocity of the drum. The aim is to have the feed speed and drum rotational speed so matched as to minimise tensioning of the sheet as it is taken up by the drum so that it should remain integral. Nevertheless, breaks in the sheet material at the transfer to the drum remain a problem.

Another reason favouring transfer to a drum-dryer is that the overall drying procedure on the belt dryer takes place rapidly at first, but decays exponentially The length of belt required makes it uneconomical to reduce moisture content below a certain value. For this reason, too, it is desirable to shorten the belt and transfer the sheet material to the post dryer.

The plant thus described in which two stage drying takes place is relatively complex and expensive and even if these considerations should be set aside, there remains the problem of sheet breakage during transfer from belt dryer to drum dryer.

OBJECT AND BRIEF SUMMARY OF THE INVENTION

It is thus an object of this invention to reduce or even eliminate the risk of sheet breakage during transfer from belt dryer to drum dryer.

According to one aspect of the present invention, there is provided a sheet drying apparatus which comprises the combination of:

a) a belt dryer comprising a belt conveyer, having a first and a second end and a continuous belt traveling, in use, over reversing rollers at said first and second ends, means for casting a slurry at said first end, means for providing steam to the underside of the belt and warm air supply means for provision of a current of warm air over the belt;

b) means for removal of the cast sheet material from said second end of the belt; and c) a post dryer arrangement for completing drying of the sheet material to a predetermined moisture content, characterised in that the post dryer arrangement is formed of a plurality of steam plates in side-by-side arrangement to receive sheet material from said second end of the belt dryer and providing a substantially flat surface for travel of the sheet material thereover, the plates being hollow and provided with supply means for supply to the interior thereof of a heated fluid medium having a temperature which increases from upstream end plate to downstream end plate.

The warm air flow to the belt dryer preferably operates with air flow in counterflow to the direction of travel of the slurry. By admitting, in a central region of the belt, air flows in countercurrent towards the beginning of the belt and in co-current towards the end (downstream) of the belt, most efficient removal of moisture is achieved. Moisture removal from the vicinity of the sheet material being dried on the steam plate table, or plate dryer, is also generally achieved by a current of warm air, the warm air here preferably flowing in the direction of travel of the sheet material. Otherwise, with the sheet now being relatively dry, there would be a risk of the sheet lifting from the plate dryer under the action of co-current air. At the downstream end of the plate dryer there will generally be a cutting arrangement for the sheet material.

In the practice of the present invention, the plate dryer may readily be positioned so as to provide an almost continuous surface from the belt conveyer thereonto. If necessary, a short conveyor which may driven by an end roller of the belt conveyor may be utilised in the transfer to the plate dryer. Alternatively, a doctor blade may lift the sheet material from the belt conveyor. The sheet is fed continuously over the flat table constituted by the plate dryer and is maintained in intimate contact with the top flat surface of the plates. The use of the plates has the advantage that the heated top surface only of the plate dryer is available for drying purposes, energy efficiency being achieved by providing insulation over the lower surfaces of the steam plates. Moreover, by utilising a number of individual plates to make up the table, it is possible to supply steam of different pressure to different plates and hence have an increasing temperature profile along the length of the plate dryer to enable moisture to be driven off at a suitable rate even as far as the downstream end of the table. It has been established that the rate of drying of the sheet increases with the increase in temperature of the drying surface and this becomes more important as the sheet moisture content is lowered. Heating of the plates may conveniently be achieved by use therein of superheated steam up to a pressure of 8 atmospheres.

While the steam dryer arrangement provides an effective alternative to the use of a drum dryer, its use will generally leave the operation of the belt dryer unchanged in principle, although the belt dryer may be shorter than hitherto.

In accordance with a second aspect of the invention, there is provided an apparatus for the production of a dried cast sheet with comprises:

a) a dryer arrangement formed of a plurality of steam plates in side-by-side arrangement providing a substantially flat surface, the plates being hollow and provided with supply means for supply to the interior thereof of a heated fluid medium having a temperature which increases from upstream end plate to downstream end plate;

b) means for casting a slurry of sheet-forming material at one end of the flat surface provided by the steam plates; and c) means for causing the cast sheet material to travel over the flat surface.

Thus, the apparatus of the second aspect of the invention enables a steam plate table to be utilised to replace the belt conveyer, with associated provision of live steam within the plates, this generally being super-heated steam at a pressure of up to 8 atmospheres. Generally a greater number of plates will be required for the plate table if a belt conveyor in advance thereof is being dispensed with, but otherwise the plates will be arranged and utilised as for the post dryer table. Now, however, unlike with the first embodiment of the invention where the cast sheet material can be driven over the plate dryer as a result of momentum it possesses on reaching the latter, specific means must be provided in association with the dryer arrangement for ensuring travel of the sheet material.

For achieving such travel of the sheet material, in principle, it is possible to employ a thin (0.25 to 1 mm thick) stainless steel belt. However, preferably, to achieve the desired object of good thermal conductivity coupled with ease of separatability of dried sheets from the belt, it is preferred to use a thin belt of plastic material which has a reasonably high thermal conductivity and which retains its tensile strength at relatively high temperatures. Particularly suitable is a glass-fibre belt having aluminium metal dispersed therein and impregnated with silicone rubber. Such belt used in association with the steam plate table travels along the continuous top surface of the steam plate table in intimate contact therewith and then returns under the plates.

When working in accordance with this second aspect of the invention, the slurry is cast into the form of a sheet just prior to or on reaching the belt. Because the plates can operate at a pressure higher than atmospheric, an increase in temperature profile can be provided along the length of the dryer arrangement from the casting position onwards, thereby offering potentially higher drying rates. When the belt is formed of plastics material as aforesaid, the sheet will separate from the belt at the dry end thereof without the need for doctoring. The number of plates may be such that the sheet material obtained at the end thereof is ready for further processing. However, if a very dry sheet is required, then the use of a belt enveloped flat table together with a post drying table of plates which, in preferred practice, is generally itself to be belt enveloped, is still to be contemplated.

Particularly when the casting and drying procedures are carried out in association with a steam plate table according to the second aspect of the invention, because the belt is fully supported along its length there is no need to deal with the problem within the problem of high tensile forces between an end pulley and belt dryer in prior practice, where the tension may arise between the drum post dryer and the belt dryer upstream thereof. Moreover, when operating with a steam plate table especially according to the second aspect of the invention, a conventional air-sweep system, as used hitherto, may be utilised. Generally, air flow will be in the direction of travel of the sheet material.

Finally, in a third aspect, this invention provides a method of producing sheet material from a slurry composition, which comprises casting the slurry composition as a continuous sheet travelling over a drying surface and reducing the moisture content of the sheet as it travels over the drying surface, in which method the drying surface comprises a drying table formed of a plurality of heated plates in side-by-side arrangement and providing a substantially flat surface, the plates being hollow and having a heated fluid medium supplied to the interior of each plate to achieve a temperature profile which increases from upstream end plate to downstream end plate. When applied to production of reconstituted tobacco sheet from a slurry of 15 to 25% by weight solids content, drying to a moisture content of from 12 to 15% by weight can be readily achieved. When use is made of a belt dryer according to the first aspect of the invention, transfer to the plate dryer can be carried out with the partially dried sheet having 25 to 30% by weight moisture content, as previously.

BRIEF DESCRIPTION OF THE DRAWINGS

For a better understanding of the invention and to show how the same may be carried into effect, reference will now be made, by way of example only, to the accompanying drawings, wherein.

DETAILED DESCRIPTION OF THE PREFERRED EMBODIMENTS

Figure 1:
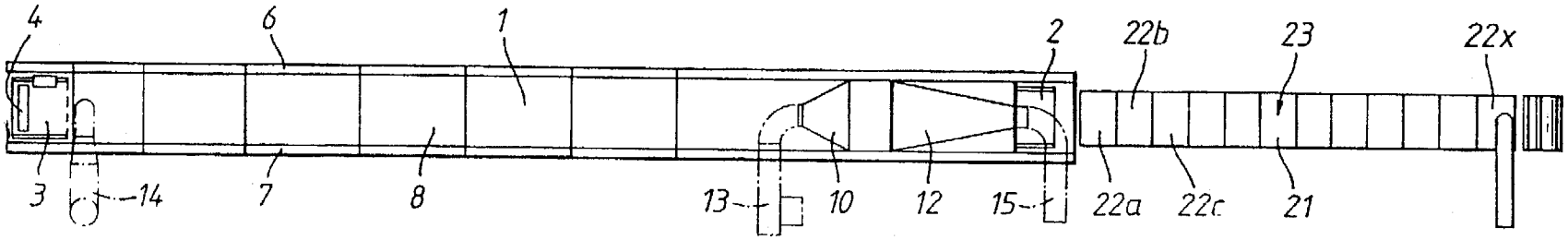
FIG. 1 is a plan view of a tobacco sheet dryer according to a first aspect of this invention.
Figure 2:
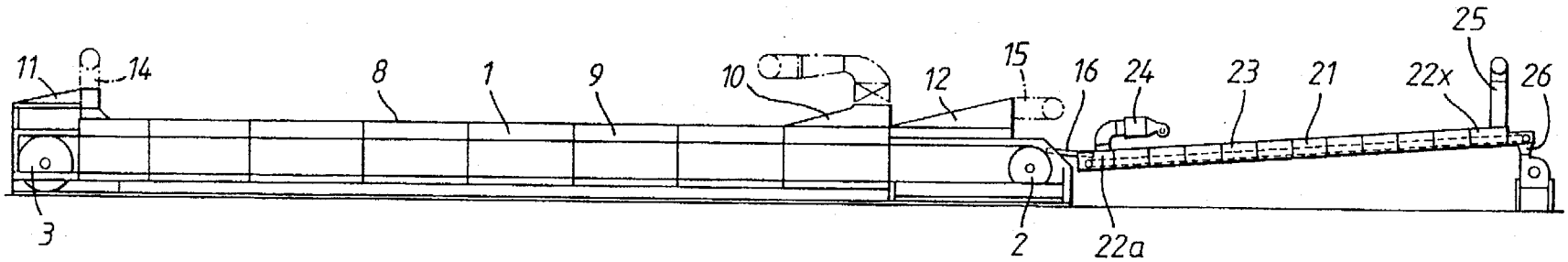
FIG. 2 is a longitudinal section through the dryer of FIG. 1.

The apparatus according to FIGS. 1 and 2 comprises a steel belt 1 having drive rollers 2 and 3 at opposite ends thereof, the roller 3 at the up-stream end being larger than the roller 2. Positioned above the roller 3 is a casting box 4 for delivery of a slurry of tobacco waste, water and binding agent typically having a solid content of 15 to 25%. Walls 6 and 7 at the side of the belt define an enclosed chamber with the belt to which is supplied steam at atmospheric pressure through means which are not shown. Above the belt is a cover 8 defining a chamber 9 over the belt equipped with a supply hood 10 positioned towards the downstream end thereof for supply of warm air in countercurrent to the direction of travel of the sheet material. A hood 11 at the upstream end of the belt is for removal of steam-laden air. A hood 12 positioned over the extreme downstream end of the belt is for removal of the last steam to be removed from the sheet material. Hoods 10, 11 and 12 have associated ducts 13, 14 and 15 respectively for supply/withdrawal of steam from the vicinity of the belt conveyer. Because the entire space below the belt is subject to the action of the steam supply, heating of the material to be dried will only take place to below 100° C.

At the downstream end of the belt there is provided a doctor arrangement 16 for lifting sheet material from the belt and transferring it to the upstream end of a steam plate table 21 which is made up of a plurality of steam plates 22*a*, 22*b* . . . 22*x* in side-by-side arrangement providing a table surface 23 over which material which has been doctored from the belt 1 is able to travel. For convenience of control of speed of the sheet material, the steam plate table is here shown to be in an upwardly inclined position. A first plate may be operated at 120° C. and the final plate may be operated at a temperature of 150° C. Again an airsweep is employed to remove moisture from the vicinity of the sheet material undergoing drying. Here, air flow is in co-current with the direction of travel of the sheet material from supply hood 24 for air flow to be removed at a hood 25. A blade cutter 26 is utilised to chop the dried sheet material into pieces of suitable size. These pieces may be collected on a conditioner (not shown) where they are subjected to dry air to bring their temperature down to ambient temperature, with possible final drying. The dried pieces are then ready for packing.

It is not essential for the table 21 to be inclined. As shown schematically in FIG. 3 it may be horizontal. The sheet undergoing drying, indicated by reference numeral 100, travels over the steam plates 22*a*, 22*b* . . . 22*x* in intimate contact therewith as will be appreciated from the detail of FIG. 3*a*, and may achieve drying to an extent sufficient to enable it to be rolled without breaking. The sheet 100 is shown to be withdrawn from the steam plate table 21 via a roller 29 to a storage roller (not shown) or may be cut into sections as described in connection with FIGS. 1 and 2. Reference numeral 27 indicates an air-drying duct for co-current air travel over the sheet being dried to remove moisture from the atmosphere thereabove.

Figure 3:
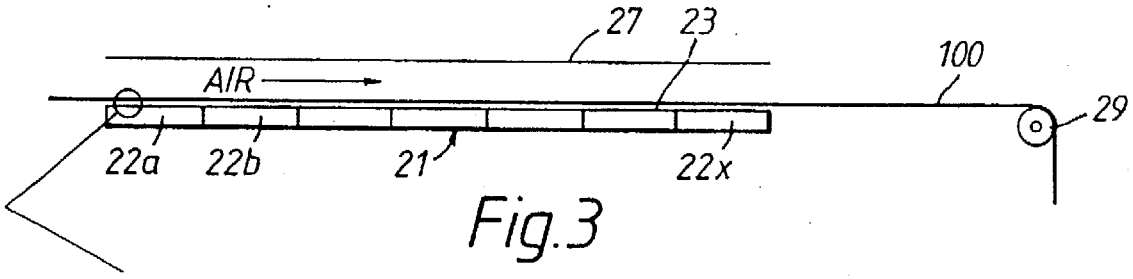
FIG. 3 shows schematically an alternative steam plate post drying table to that shown in FIG. 2.
Figure 3A:
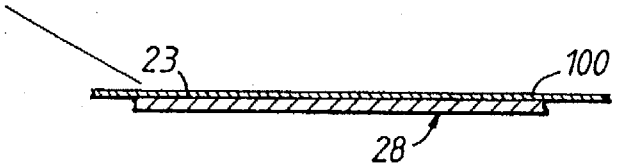
FIG. 3*a* shows a detail of FIG. 3.
Figure 4:
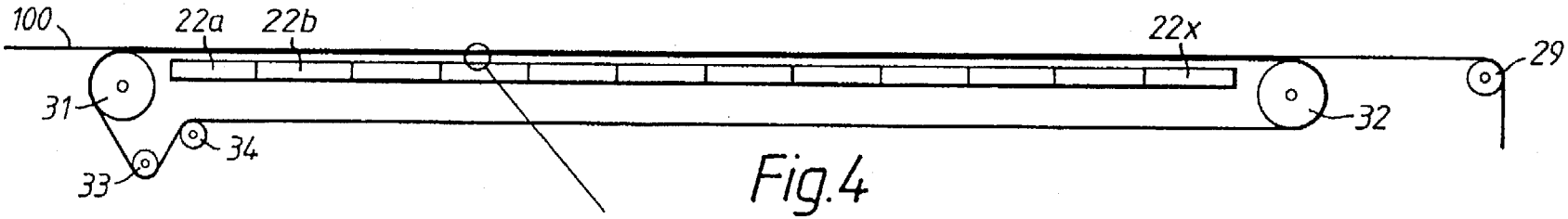
FIG. 4 is a longitudinal section through an alternative form of plate post drying table to that shown in FIG. 3.
Figure 4A:
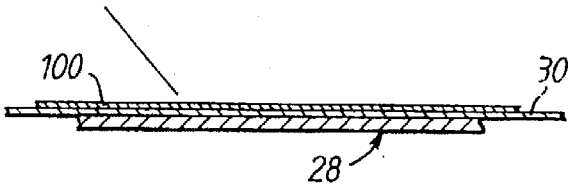
FIG. 4*a* is a detail of FIG. 4.

FIGS. 4 and 4*a*, in which like reference numerals to those used in the preceding figures indicate like parts, show a variant of the steam table of FIGS. 3 and 3*a* in which, apart from the steam plate table 21 having more individual plates, there is provided a conducting plastic belt 30 to assist the travel of the sheet 100 undergoing drying over the steam plate table 21. The sheet material to undergo completion of drying passes from an upstream belt dryer of FIG. 1 or the like on to the conducting plastic belt 30, which itself travels in a closed path over reversing rollers 31 and 32 in a path which includes a tensioning system of rollers 33 and 34 just before reaching the upstream reversing roller 31. The provision of the conducting plastic belt in a state of tension ensures the conveying of the belt 100 on the conducting plastic belt 30 with intimate contact to the belt and excellent thermal contact with the wall 28 of each steam plate 22*a*, 22*b* . . . 22*x* as a result of the conducting character of the belt. As described in connection with FIGS. 3 and 3*a*, there is produced a dried sheet which may be rolled or cut into sections after it has left the downstream end of the steam table 21.

Figure 5:
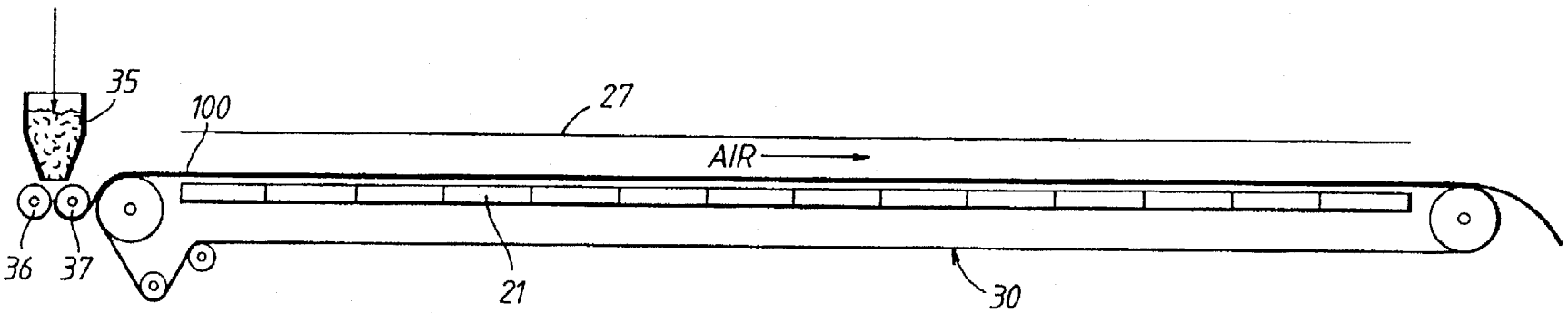
FIG. 5 is a longitudinal section through a sheet drying apparatus according to a second aspect of the invention.

Turning finally to FIG. 5, where again like reference numerals denote like parts in the foregoing drawings, here a like arrangement of conducting plastic belt 30 travelling over steam plate table 21 to that shown in FIG. 4*a* is to be seen. Because of the increased length of the steam plate table 21 it is even possible for the belt dryer upstream of the plate dryer to be dispensed with. Thus a slurry of castable material is supplied from a hopper 35 to the nip of a pair of casting rollers 36, 37 of which the downstream roller 37 is driven to convey freshly cast sheet material 100 onto the conducting plastic belt 30 to be conveyed thereby along the upper surface of the steam plate table 21. The sheet leaves the table 21 with sufficient cohesivehess to enable it to be rolled if it is not required that it be cut into sheets.

What is claimed is:

1. A sheet drying apparatus, for use with a supply means for supplying a heated fluid medium, comprising:

a) a belt dryer comprising a belt conveyor having a first end, a second end and a continuous belt traveling, in use, over reversing rollers at said ends, means for casting a slurry thereon at said first end, means for providing steam to the underside of the belt and warm air supply means for provision of a current of warm air over the belt;

b) means for removal of the cast sheet material from said second end of the belt; and c) a post dryer arrangement for completing drying of the sheet material to a predetermined moisture content, wherein the post dryer arrangement is formed of a plurality of steam plates in side-by-side arrangement to receive sheet material from said second end of the belt dryer and providing a substantially flat surface for travel of the sheet material thereover, the plates being hollow and connectable to the supply means for supplying to the interior thereof the heated fluid medium so that temperature increases from upstream end plate to downstream end plate.

2. Apparatus as claimed in claim 1, wherein said means for removal comprises a doctor blade for lifting the sheet material from the belt conveyor on to the post dryer arrangement.

3. Apparatus as claimed in claim 1, having a warm air duct for supply of a countercurrent supply of warm air over the belt conveyor.

4. Apparatus as claimed in claim 1, wherein a belt of thermally conductive plastic material is associated with the plurality of steam plates for conveying said sheet thereover.

5. Apparatus as claimed in claim 4, wherein the belt of plastic material is a glass fibre belt having aluminium metal dispersed therein, the belt being impregnated with silicone rubber.

6. Apparatus for the production of a dried cast sheet, using a supply means for supplying a heated fluid medium, comprising:

a) a dryer arrangement formed of a plurality of steam plates in side-by-side arrangement providing a substantially flat surface, the plates being hollow and connectable to the supply means for supply to the interior thereof of a heated fluid medium having a temperature which increases from an upstream end plate to a downstream end plate for heat transfer by conduction to material traveling over the surface;

b) means for providing a cast slurry of sheet-forming material at one end of the flat surface provided by the steam plates; and c) means for causing the cast sheet material to travel over the surface.

7. Apparatus as claimed in claim 6, wherein a driven belt of thermally conductive plastic material is associated with the plurality of steam plates for conveying said sheet thereover.

8. Apparatus as claimed in claim 7, wherein the belt of plastic material is a glass fibre belt having aluminium metal included therein and impregnated with silicone rubber.

9. Apparatus as claimed in claim 1, wherein the plates contain superheated steam at a pressure of up to 8 atmospheres.

10. Apparatus as claimed in claim 6, wherein the plates contain superheated steam at a pressure of up to 8 atmospheres.

11. A method of producing sheet material from a slurry composition, comprising:

casting the slurry composition as a continuous sheet travelling over a drying surface;

reducing moisture content of the sheet as it travels over the drying surface, the drying surface including a drying table formed of a plurality of heated plates in side-by-side arrangement and providing a substantially flat surface, the plates being hollow; and supplying a heated fluid medium to the interior of each plate to achieve a temperature profile which increases from upstream end plate to downstream endplate.

12. A method as claimed in claim 11, which is applied to the drying of reconstituted tobacco sheet, produced from a slurry of 15 to 25% by weight solids content to reduce its moisture content to from 12 to 15% by weight.

13. A method as claimed in claim 12, wherein superheated steam is supplied to the interior of the plates under a pressure of up to 8 atmospheres.

14. A method as claimed in claim 11, wherein preliminary drying of the sheet is carried out on a belt dryer comprising a belt conveyor having a body of steam thereunder, before transfer of the sheet to the drying table for travel thereover, the sheet being cast directly onto the belt conveyor.

15. A method as claimed in claim 14, wherein the sheet has a moisture content of from 25 to 30% by weight when it is transferred to the drying table.

16. A method of producing sheet material from a slurry composition, comprising:

casting the slurry composition as a continuous sheet travelling over a drying surface;

reducing moisture content of the sheet as it travels over the surface, the drying surface including a drying table formed of a plurality of heated plates in side-by-side arrangement and providing a substantially flat surface, the plates being hollow; and supplying a heated fluid medium to the interior of each plate to achieve a temperature profile which increases from upstream end plate to downstream endplate;

wherein preliminary drying of the sheet is carried out on a belt dryer including a belt conveyor having a body of steam thereunder, before transfer of the sheet to the drying table for travel thereover, the sheet being cast directly onto the belt conveyor, which method is applied to the drying of reconstituted tobacco sheet, produced from a slurry of 15 to 25% by weight solids content to reduce its moisture content to from 12 to 15% by weight.

17. A method as claimed in claim 16, wherein the sheet has a moisture content of from 25 to 30% by weight when it is transferred to the drying table.

18. A method as claimed in claim 11, wherein the casting of the slurry composition as a continuous sheet traveling over the drying table is effected by feeding the slurry to a pair of casting rollers which are in side-by-side arrangement and define therebetween a nip which the slurry passes through to emerge as a cast sheet and wherein the cast sheet is taken up by a conveyor belt traveling over the drying table and dried as it is conveyed over the drying surface thereof.

* * * * *